United States Patent [19]

Wu et al.

[11] Patent Number: 4,928,836

[45] Date of Patent: May 29, 1990

[54] BABY BOTTLE WITH AIR VALVE

[76] Inventors: Min-Yu Wu; Andrew H. Wu, both of 1219 Brandybuck Way, San Jose, Calif. 95121

[21] Appl. No.: 252,813

[22] Filed: Sep. 28, 1988

[51] Int. Cl.[5] ..... A61J 9/04

[52] U.S. Cl. ..... 215/11.5; 215/11.4; 137/542

[58] Field of Search ..... 215/11.5, 11.4; 137/542

[56] References Cited

U.S. PATENT DOCUMENTS

| | | | |
|---|---|---|---|
| 1,732,126 | 10/1929 | Gardner | 215/11.5 |
| 2,022,083 | 11/1935 | Geistlinger | 215/11.5 |
| 2,084,099 | 6/1937 | MacCoy | 215/11.5 |
| 2,711,169 | 6/1955 | Hull et al. | 128/204.29 |
| 2,825,479 | 3/1958 | Litzie | 215/11.5 |
| 3,200,980 | 8/1965 | Jamell | 215/11.5 |
| 3,292,808 | 12/1966 | Greene | 215/11.5 |
| 4,685,577 | 8/1987 | Chen | 215/11.5 |

FOREIGN PATENT DOCUMENTS

| | | | |
|---|---|---|---|
| 285744 | 7/1914 | Fed. Rep. of Germany | 215/11.5 |

*Primary Examiner*—Stephen Marcus
*Assistant Examiner*—Christine A. Peterson
*Attorney, Agent, or Firm*—Rosenblum, Parish & Bacigalupi

[57] ABSTRACT

An air valve for a baby bottle that fits in the side of the baby bottle. A valve is disposed interior of an air pressure-sensitive diaphragm to permit air to enter the bottle when liquid is removed.

4 Claims, 2 Drawing Sheets

BABY BOTTLE WITH AIR VALVE

BACKGROUND OF THE INVENTION

1. Field of the Invention

This invention relates to baby bottles and more particularly to baby bottles having pressure-sensitive air valves disposed therein.

2. Description of the Prior Art

Baby bottles having pressure-sensitive air valves are known. Such prior art includes U.S. Pat. Nos. 4,730,744; 3,768,683; 2,379,562; 1,827,100; 2,825,479; 3,768,682; 2,321,236; and 3,292,808. All disclose various types of air pressure relief valves for baby bottles. Such prior art devices typically are relatively slow in reacting to the air pressure differential, do not react to a small air pressure differential, have fluid leakage problems, and may be relatively costly to manufacture.

SUMMARY OF THE INVENTION

It is an object of the present invention to provide a baby bottle having an air valve that is sensitive to a small pressure differential.

It is another object of the present invention to provide a baby bottle having an air valve that is formed with a large air pressure-sensitive diaphragm to react to small pressure differentials.

It is a further object of the present invention to provide a baby bottle having an air valve that inlets air automatically to compensate for a pressure differential.

It is yet another object of the present invention to provide a baby bottle having an air valve that contains small air inlet holes to prevent fluid leakage.

It is yet a further object of the present invention to provide a baby bottle having an air valve that is easy to clean.

It is still another object of the present invention to provide a baby bottle having an air valve that is formed with a convex diaphragm which acts as a pre-loaded spring force.

It is still a further object of an alternative embodiment of the present invention to provide a baby bottle having an air valve that includes a pre-compressed spring to actively close the air intake valve upon cessation of a pressure differential.

The baby bottle of the present invention includes an automatically acting air valve which automatically compensates for the air pressure differential created by the removal of fluid from within the bottle. The air valve includes a diaphragm which acts as a wall element of the bottle. Air Inlet holes are formed through the diaphragm. A support member supports the valve structure that is disposed within the bottle. The valve elements include a housing having an air inlet aperture formed therethrough and a moveable valve member that sealingly engages the valve housing. The valve member is joined to the diaphragm by a push rod. A flexible, bellows-like connector joins the moveable diaphragm to the fixed housing and forms a fluid-tight chamber that conducts air from the diaphragm air inlet holes through the valve housing upon the creation of an air differential.

It is an advantage of the present invention that it provides a baby bottle having an air valve that is sensitive to a small pressure differential.

It is another advantage of the present invention that it provides a baby bottle having an air valve that is formed with a large air pressure-sensitive diaphragm to react to small pressure differentials.

It is a further advantage of the present invention that it provides a baby bottle having an air valve that inlets air automatically to compensate for a pressure differential.

It is yet another advantage of the present invention that it provides a baby bottle having an air valve that contains small air inlet holes to prevent fluid leakage.

It is yet a further advantage of the present invention that it provides a baby bottle having an air valve that is easy to clean.

It is still another advantage of the present invention that it provides a baby bottle having an air valve that is formed with a convex diaphragm which acts as a pre-loaded spring force.

It is still a further advantage of an alternative embodiment of the present invention that it provides a baby bottle having an air valve that includes a precompressed spring to actively close the air intake valve upon cessation of a pressure differential.

The foregoing and other objects, features, and advantages of the present invention will be apparent from the following detailed description of the preferred embodiments which make reference to the several figures of the drawing.

IN THE DRAWINGS

DESCRIPTION OF THE PREFERRED EMBODIMENTS

Figure 1:
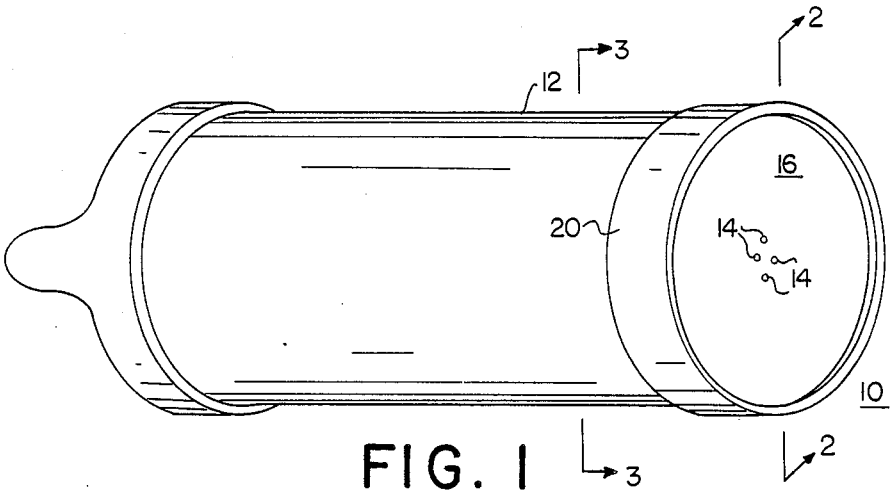
FIG. 1 is a perspective view of a baby bottle having the air valve of the present invention disposed at the bottom thereof.

A baby bottle having the air valve of the present invention 10 is depicted in FIG. 1. In this preferred embodiment, the air valve 10 forms the bottom of the baby bottle 12. Four pinholes which permit outside air to enter the baby bottle are formed through a diaphragm 16 which acts as the bottom wall of the baby bottle. Further details of the air valve 10 are next presented with the aid of FIGS. 2, 3 and 4.

Figure 3:
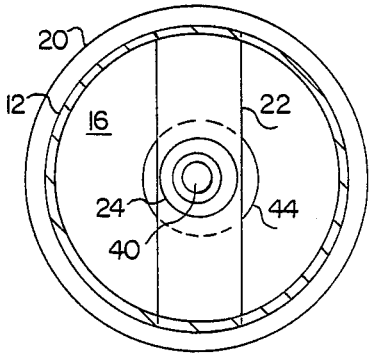
FIG. 3 is a cross-sectional view of a baby bottle taken along lines 3—3 of FIG. 1.
Figure 4:
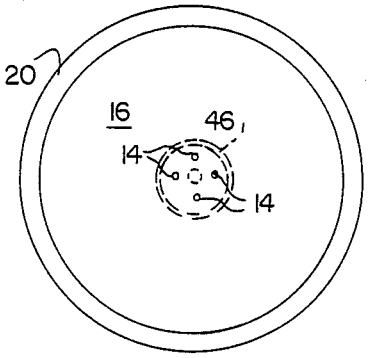
FIG. 4 is a bottom plan view of the baby bottle air valve of the present invention.
Figure 2:
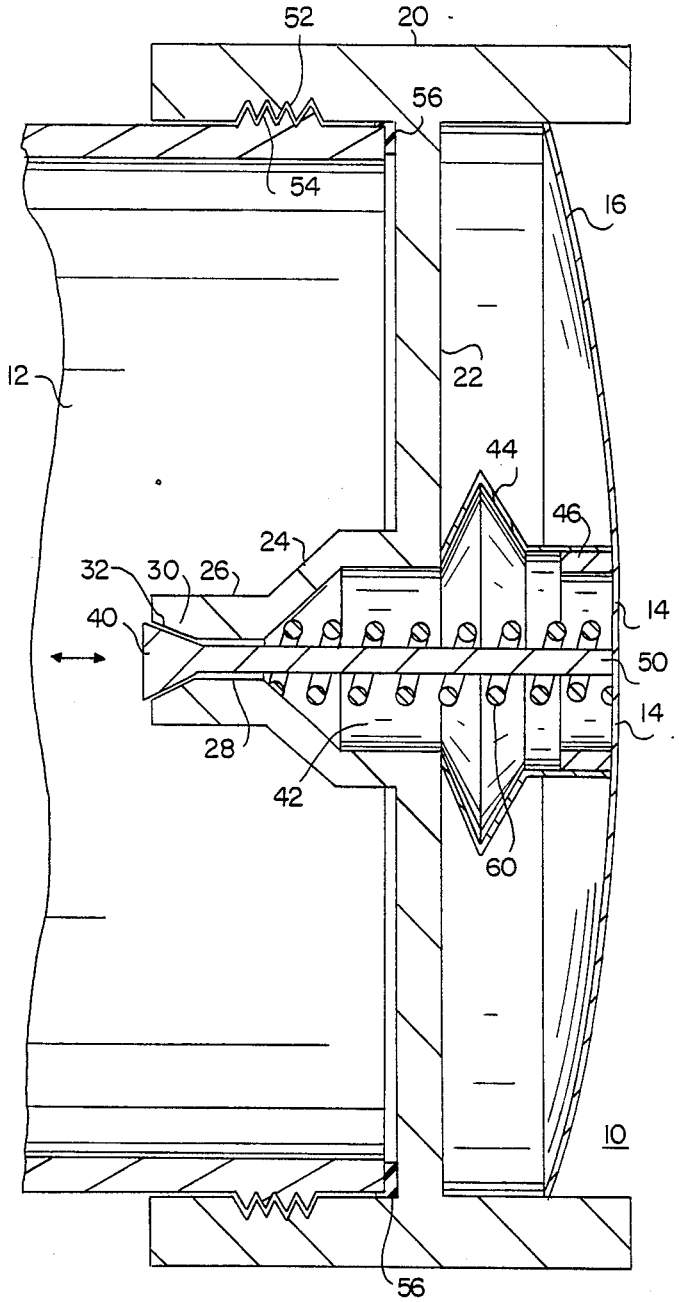
FIG. 2 is a cross-sectional view of the baby bottle air valve of the present invention, taken along lines 2—2 of FIG. 1.

FIG. 2 depicts a side cross-sectional view of the air valve 10, taken along lines 2—2 of FIG. 1. FIG. 3 depicts a top plan view of the air valve 10, taken from the direction of arrows 3—3 of FIG. 2. FIG. 4 depicts a bottom plan view of the air valve 10 and shows portions of the inner structure in phantom. As depicted in FIGS. 2, 3 and 4, the air valve 10 includes a cylindrical outer housing 20 having a beam-like rigid valve housing support bar 22 that is diametrically disposed across the cylindrical outer housing 20. A cylindrical air valve housing 24 is centrally disposed upon and supported by the support bar 22. The air valve housing 24 is formed as a hollow cylinder that projects internally into the bottle 12. The inwardly projecting portion 26 of the housing 24 is formed with a centrally disposed air passage bore 28, the inward end 30 of said bore 28 being flared outwardly to form an airtight seal with a matingly flared valve member 40. In the preferred embodiment, the outer housing 20, support bar 22 and valve housing 24 are all integrally formed in one piece, such as by an injection molding process.

As is best seen with the aid of FIG. 2, the air passage bore 28 communicates with a larger diameter air passage 42 that is centrally disposed within the cylindrical air valve housing 24. The air passage 42 is formed through the support bar 22. A bellows-like flexible connector 44 is joined to the lower surface of the support bar 22. The connector 44 is sealed, such as by using an adhesive, to the support bar in such a manner as to encircle the air passage 42 and produce an airtight seal. The lower end of the connector 44 is joined in an airtight seal to the central area of the diaphragm 16. A hollow, cylindrical joining member 46 is preferably utilized to facilitate the joining of the thin-walled flexible connector 44 to the thin-walled diaphragm 16. The pinholes 14, which permit the entry of air through the diaphragm 16, are disposed within the cylindrical support member 46, such that air entering through the pinholes 14 will be enclosed within the flexible connector 44 and air chamber 42. A push rod 50 is centrally engaged to the diaphragm 16 at its lower end, and to the valve member 40 at its other end.

The outer housing 20 is formed with internal threads 52 which are disposed to threadably engage external threads 54 formed proximate the bottom of the sidewalls of the bottle 12. A circular gasket 56 is disposed within the outer housing 20, proximate the internal threads 52 thereof, to form a liquid-tight seal, such that the liquid within the bottle does not escape through the threaded engagement between the bottle 12 and the outer housing 20. It is therefore to be appreciated that the diaphragm 16 forms the bottom wall of the bottle 12 such that liquid within the bottle will contact it. Likewise, the flexible connector 44 and valve housing 24 form a primarily liquid-free air chamber. The operation of the device can now be described.

Upon the removal of liquid from the bottle, such as by the sucking action of a baby, an air pressure differential will be created between the outside air pressure and the air pressure within the bottle. The differential air pressure will cause the diaphragm 16 to be drawn inwardly, whereupon the push rod 50 will cause the valve member 40 to disengage from its sealing engagement with the inward end 30 of the housing 24. External air will then be drawn through the pinholes 14, through the air chamber 42 and through the valve opening created by the inward action of the push rod, to equalize the external and internal air pressure. Upon the equalization of the air pressure, the diaphragm 16 will spring back to its non-pressured position, drawing the push rod with it and closing the gap between the valve member 40 and the valve housing 30, thus sealing the valve.

As depicted in FIG. 2, the diaphragm 16 is preferably formed with a convex, outward curve to provide a natural spring force that will cause the diaphragm to move outwardly upon the cessation of a pressure differential. In an alternative embodiment of the present invention, a compressed, coiled spring 60 may be placed around the push rod 50 within the air chamber 42, such that one end of the spring 60 presses outwardly upon the diaphragm 16 and the other end of the spring 60 engages the internal surface of the valve housing 24. The spring, when utilized, serves to increase the speed with which the valve is closed following the cessation of an air pressure differential.

It is to be realized that some liquid within the baby bottle will enter the air chamber 42 through the opening between the valve member 40 and the housing 30 when air is being inletted into the bottle. However, a quantity of liquid within the air chamber 42 will not appreciably diminish the operational characteristics of the invention. Nevertheless, when liquid is contained within the air chamber 42, it is important to prevent the liquid from leaking through the air holes 14 formed in the diaphragm. To help prevent liquid from escaping, the holes 14 are formed as pinholes, such that the surface tension of the liquid relative to the diameter of the pinholes will aid in preventing the liquid from escaping through the pinholes.

The air valve 10 is advantageously designed with a relatively large diameter, thin-walled diaphragm. This design increases the pressure sensitivity of the air valve 10, such that it reacts to small air pressure differentials. In the preferred embodiment, the convex diaphragm is formed with a diameter of approximately 2 inches, a wall thickness of approximately 0.04 inches, and a radius of curvature of approximately 8 inches such that the bulge in the convex diaphragm is approximately 1/16 inch from its endges; the preferred material is a non-toxic plastic such as polyethelene, however, materials such as polyesters and other flexible plastics can also be utilized.

In an alternative embodiment of the present invention, the diaphragm can be flat, rather than having a convex curvature as depicted in FIG. 2. Where a flat diaphragm is utilized, a coil spring 60 is necessary to provide adequate spring force for rapidly closing the valve following the injection of air through the valve into the bottle.

While the invention has been particularly shown and described with reference to certain preferred embodiments, it will be understood by those skilled in the art that various alterations and modifications in form and detail may be made therein. Accordingly, it is intended that the following claims cover all such alterations and modifications as may fall within the true spirit and scope of the invention.

What I claim is:

1. A baby bottle having a pressure-sensitive air valve, comprising:

a baby bottle having a portion of the wall thereof removed;

an air valve having a means for engagement thereof to said baby bottle, such that said air valve will enclose said portion of said baby bottle where said wall portion is removed, whereby said baby bottle will retain liquid upon the engagement of said air valve therewith;

said air valve including a rigid valve housing and an air pressure-sensitive member, said air pressure-sensitive member being sealingly engaged within said housing and forming a wall of said baby bottle;

said air pressure-sensitive member having at least one air hole formed therethrough to permit air to enter said baby bottle;

portions of said air valve being formed as an air chamber, said air chamber being sealingly engaged to said air pressure-sensitive member proximate said air hole, whereby air passing through said air hole will enter said air chamber;

a valve means being fixedly engaged to said air pressure-sensitive member and disposed for forming an airtight seal with portions of said valve housing;

said air pressure-sensitive member including a thin-walled diaphragm;

whereupon movement of said air pressure-sensitive member will cause disengagement of said valve means from said valve housing, whereupon air from said air chamber will enter said baby bottle.

2. A baby bottle having an air pressure-sensitive air valve, comprising:

a baby bottle having a portion of a wall thereof removed;

an air valve having a means for a liquid-tight engagement thereof to said baby bottle proximate said removed wall portion thereof;

said air valve including a rigid valve outer housing including a support structure engaged thereto;

an air pressure-sensitive diaphragm being engaged to said outer housing and forming a wall of said baby bottle; said diaphragm having an outer diaphragm surface and an inner diaphragm surface that forms an inner surface of said wall;

a flexible, bellows-like connector member having a first end and a second end, said connector member being engaged at said first end thereof to said inner diaphragm surface of said diaphragm and disposed to form an airtight seal with a central portion of said diaphragm;

said second end of said connector member being engaged with an airtight seal to portions of said support structure disposed within the baby bottle;

centrally disposed portions of said support structure being formed as an inner air valve housing defining an air chamber in pneumatic communication with said connector member;

a valve member being disposed proximate said inner air valve housing and formed for a releasable, sealable engagement with mating portions of said inner air valve housing;

a push rod being engaged at one end thereof to said diaphragm and at the other end thereof to said valve member, said push rod being disposed within said air chamber;

at least one air hole being formed through said diaphragm and operating to permit the passage of air therethrough into said air chamber.

3. The device as described in claim 2 wherein said outer housing, said support means, and said inner air valve housing are integrally formed.

4. The device as described in claim 3 wherein said valve housing is threadably engaged with portions of said baby bottle.

* * * * *